US006708767B2

(12) United States Patent
Harrall et al.

(10) Patent No.: US 6,708,767 B2
(45) Date of Patent: Mar. 23, 2004

(54) DOWNHOLE TUBING

(75) Inventors: Simon John Harrall, Aberdeenshire (GB); Paul David Metcalfe, Peterculter (GB); Frederick T. Tilton, Spring, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 34 days.

(21) Appl. No.: 10/032,998

(22) Filed: Oct. 25, 2001

(65) Prior Publication Data

US 2002/0108756 A1 Aug. 15, 2002

(30) Foreign Application Priority Data

Oct. 25, 2000 (GB) ..... 0026063

(51) Int. Cl.[7] ..... E21B 23/02
(52) U.S. Cl. ..... 166/382; 166/207; 166/217
(58) Field of Search ..... 166/380, 382, 166/384, 385, 277, 207, 206, 210, 212, 216, 217

(56) References Cited

U.S. PATENT DOCUMENTS

| | | | | |
|---|---|---|---|---|
| 761,518 | A | 5/1904 | Lykken | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,930,825 | A | 10/1933 | Raymond | 153/81 |
| 2,383,214 | A | 8/1945 | Prout | 153/82 |
| 2,499,630 | A | 3/1950 | Clark | 153/81 |
| 2,627,891 | A | 2/1953 | Clark | 153/82 |
| 2,663,073 | A | 12/1953 | Bieber et al. | 29/148 |
| 2,898,971 | A | 9/1959 | Hempel | 153/82 |
| 3,087,546 | A | 4/1963 | Wooley | 166/46 |
| 3,195,646 | A | 7/1965 | Brown | 166/208 |
| 3,467,180 | A | 9/1969 | Pensotti | 165/180 |
| 3,818,734 | A | 6/1974 | Bateman | 72/75 |
| 3,911,707 | A | 10/1975 | Minakov et al. | 72/76 |
| 4,069,573 | A | 1/1978 | Rogers, Jr. et al. | 29/421 R |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,324,407 | A | 4/1982 | Upham et al. | 277/27 |
| 4,429,620 | A | 2/1984 | Burkhardt et al. | 91/395 |
| 4,531,581 | A | 7/1985 | Pringle et al. | 166/120 |

(List continued on next page.)

FOREIGN PATENT DOCUMENTS

| | | | |
|---|---|---|---|
| EP | 0 961 007 A2 | 12/1999 | E21B/33/10 |
| GB | 2 320 734 A | 7/1998 | E21B/33/127 |
| WO | WO 93/24728 | 12/1993 | E21B/17/10 |
| WO | WO 99/18328 | 4/1999 | E21B/23/01 |
| WO | WO 99/23354 | 5/1999 | E21B/43/10 |
| WO | WO 00/31375 | 6/2000 | E21B/43/10 |

OTHER PUBLICATIONS

PCT International Search Report dated Jan. 18, 2002 for application Ser. No. PCT/GB01/04763.

(List continued on next page.)

*Primary Examiner*—Frank Tsay
(74) *Attorney, Agent, or Firm*—Moser, Patterson & Sheridan, L.L.P.

(57) ABSTRACT

A downhole apparatus comprises a plurality of tubing sections. Each tubing section has substantially cylindrical portions initially of a first diameter for coupling to end portions of adjacent tubing sections. The end portions are expandable to a larger second diameter. Each tubing section also has an intermediate folded wall portions initially in a folded configuration. The intermediate folded wall portions are unfoldable to define a substantially cylindrical form of a third diameter.

31 Claims, 2 Drawing Sheets

U.S. PATENT DOCUMENTS

| | | | | |
|---|---|---|---|---|
| 4,588,030 | A | 5/1986 | Blizzard | 166/120 |
| 4,697,640 | A | 10/1987 | Szarka | 166/120 |
| 4,848,469 | A | 7/1989 | Baugh et al. | 166/382 |
| 5,083,608 | A | 1/1992 | Abdrakhmanov et al. | 166/55 |
| 5,271,472 | A | 12/1993 | Leturno | 175/107 |
| 5,409,059 | A | 4/1995 | McHardy | 166/208 |
| 5,435,400 | A | 7/1995 | Smith | 175/61 |
| 5,472,057 | A | 12/1995 | Winfree | 175/57 |
| 5,560,426 | A | 10/1996 | Trahan et al. | 166/120 |
| 5,685,369 | A | 11/1997 | Ellis et al. | 166/195 |
| 5,901,787 | A | 5/1999 | Boyle | 166/135 |
| 6,021,850 | A | 2/2000 | Wood et al. | 166/380 |
| 6,098,717 | A | 8/2000 | Bailey et al. | 166/382 |

OTHER PUBLICATIONS

Abdrakhmanov et al, "Isolation profile liner helps stabilize problem well bores", *Oil & Gas Journal*, vol. 93, No. 37, p. 50–52, Sep. 11, 1995.

U.S. patent application Ser. No. 09/470,176, Metcalfe et al., filed Dec. 22, 1999.

U.S. patent application Ser. No. 09/469,690, Abercrombie, filed Dec. 22, 1999.

U.S. patent application Ser. No. 09/469,643, Metcalfe et al., filed Dec. 22, 1999.

U.S. patent application Ser. No. 09/469,526, Metcalfe et al., filed Dec. 22, 1999.

U.S. patent application Ser. No. 09/470,154, Metcalfe et al., filed Dec. 22, 1999.

U.S. patent application Ser. No. 09/469,681, Metcalfe et al., filed Dec. 22, 1999.

U.S. patent application Ser. No. 09/469,692, Trahan, filed Dec. 22, 1999.

DOWNHOLE TUBING

FIELD OF THE INVENTION

This invention relates to deformable tubing, and in particular to deformable tubing for use in downhole applications.

BACKGROUND OF THE INVENTION

There have been numerous proposals for forms of deformable tubing for use in downhole applications. One such form is relatively thin-walled "C-shaped" or "folded" tubing which comprises tubing which is or has been collapsed, flattened, corrugated, folded or otherwise deformed to assume a smaller diameter configuration. One example of such tubing is described in U.S. Pat. No. 5,794,702 (Nobileau). For brevity, such tubing will hereinafter be referred to as "folded" tubing. The tubing, which is typically continuous and reelable, is run into a bore in the folded configuration and then unfolded, by use of an appropriately shaped cone or application of internal pressure, to assume a larger diameter cylindrical form.

Use of such folded tubing is also disclosed in EP 0 952 306 A1 (Shell Internationale Research Maatschappij B. V.), the various forms of folded tube being spooled around a reeling drum in their folded shape and reeled from the drum into an underground borehole.

WO 99/35368 (Shell Internationale Research Maatschappij B. V.) discloses methods for drilling and completing a hydrocarbon production well. The well is lined with tubing which is expanded downhole to provide a slim borehole of almost uniform diameter. In one embodiment, the tubing is made up of a series of pipe sections that are interconnected at the wellhead by screw joints, welding or bonding to form an elongate pipe of a substantially cylindrical shape that can be expanded and installed downhole.

It is among the objectives of embodiments of the present invention to facilitate use of folded tubing in downhole applications, and in particular to permit use of tubing made up from a plurality of folded pipe sections which may be coupled to one another at surface before being run into the bore.

SUMMARY OF THE INVENTION

According to a first aspect of the present invention there is provided downhole apparatus comprising a plurality of tubing sections, each tubing section having substantially cylindrical end portions initially of a first diameter for coupling to end portions of adjacent tubing sections and being expandable at least to a larger second diameter, and intermediate folded wall portions initially in a folded configuration and being unfoldable to define a substantially cylindrical form at least of a larger third diameter.

The invention also relates to a method of lining a bore using such apparatus.

Thus, the individual tubing sections may be coupled together via the end portions to form a string to be run into a bore. The tubing string is then reconfigured to assume a larger diameter configuration by a combination of mechanisms, that is at least by unfolding the intermediate portions and expanding the end portions. The invention thus combines many of the advantages available from folded tubing while also taking advantage of the relative ease of coupling cylindrical tubing sections; previously, folded tubing has only been proposed as continuous reelable lengths, due to the difficulties that would be involved in coupling folded tubing sections.

Preferably, transition portions are be provided between the end portions and the intermediate portions, and these portions will be deformable by a combination of both unfolding and expansion. The intermediate wall portion, transition portions and end portions may be formed from a single piece of material, for example from a single extrusion or a single formed and welded sheet, or may be provided as two or more parts which are assembled. The different parts may be of different materials or have different properties. The end portions may be foldable, and may have been previously folded. Alternatively, or in addition, the end portions may be folded following coupling or making up with other end portions. This would allow cylindrical tubing sections to be made up on site, and then lowered into a well through a set of rollers which folded the tubulars including the end portions, into an appropriate, smaller diameter folded configuration. Indeed, in certain aspects of the invention the end portion may only be subject to unfolding, and may not experience any expansion.

The end portions may be provided with means for coupling adjacent tubing sections. The coupling means may be in the form of male or female threads which allow the tubing sections to be threaded together. Alternatively, or in addition, the coupling means may comprise adhesive or fasteners, such as pins, bolts or dogs, or may provide for a push or interference type coupling. Other coupling means may be adapted to permit tubing section to be joined by welding or by amorphous bonding. Alternatively, or in addition, the apparatus may further comprise expandable tubular connectors. In one embodiment, an expandable connector may define female threads for engaging male threaded end portions of the tubing sections.

Preferably, the first diameter is smaller than the third diameter. The second and third diameters may be similar. Alternatively, the unfolded intermediate wall portions may be expandable from the third diameter to a larger fourth diameter, which fourth diameter may be similar to the second diameter.

According to another aspect of the present invention there is provided a method of creating a bore liner, the method comprising:

- providing a tubing section having a folded wall and describing a folded diameter;
- running the tubing section into a bore;
- unfolding the wall of the tubing section to define a larger unfolded diameter; and
- expanding the unfolded wall of the tubing section to a still larger diameter.

This unfolding and expansion of the tubing section is useful in achieving relatively large expansion ratios which are difficult to achieve using conventional mechanisms, and also minimising the expansion forces necessary to achieve desired expansion ratios.

The unfolding and expansion steps may be executed separately, or may be carried out in concert. One or both of the unfolding and expansion steps may be achieved by passing an appropriately shaped mandrel or cone through the tubing, by applying internal pressure to the tubing, or preferably by rolling expansion utilising a rotating body carrying one or more rolling members, most preferably a first set of rolling members being arranged in a conical form or having a tapered form to achieve the initial unfolding, and a further set of rolling members arranged to be urged radially outwardly into contact with the unfolded tubing section wall. Of course, the number and configuration of the rolling member sets may be selected to suit particular applications or configurations. The initial deformation or unfolding may be achieved by simple bending of the tubing wall, and subsequent expansion by radial deformation of the wall, reducing the wall thickness and thus increasing the wall diameter.

The tubing section may be reelable, but is preferably formed of jointed pipe, that is from a plurality of shorter individual pipe sections which are connected at surface to make up a tubing string. Alternatively, the tubing section may be in the form of a single pipe section to be used as, for example, a straddle.

Preferably, an upper portion of the tubing section is deformed initially, into contact with a surrounding wall, to create a hanger and to fix the tubing section in the bore. Most preferably, said upper portion is initially substantially cylindrical and is expanded to create the hanger. The remainder of the tubing section may then be unfolded and expanded.

The tubing section may be expanded into contact with the bore wall over some or all of the length of the tubing section. Where an annulus remains between the tubing section and the bore wall this may be filled or partially filled by a settable material, typically a cement slurry. Cementation may be carried out before or after expansion. In other embodiments, a deformable material, such as an elastomer, may be provided on all or part of the exterior of the tubing section, to facilitate formation of a sealed connection with a surrounding bore wall or surrounding tubing.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figure 1:
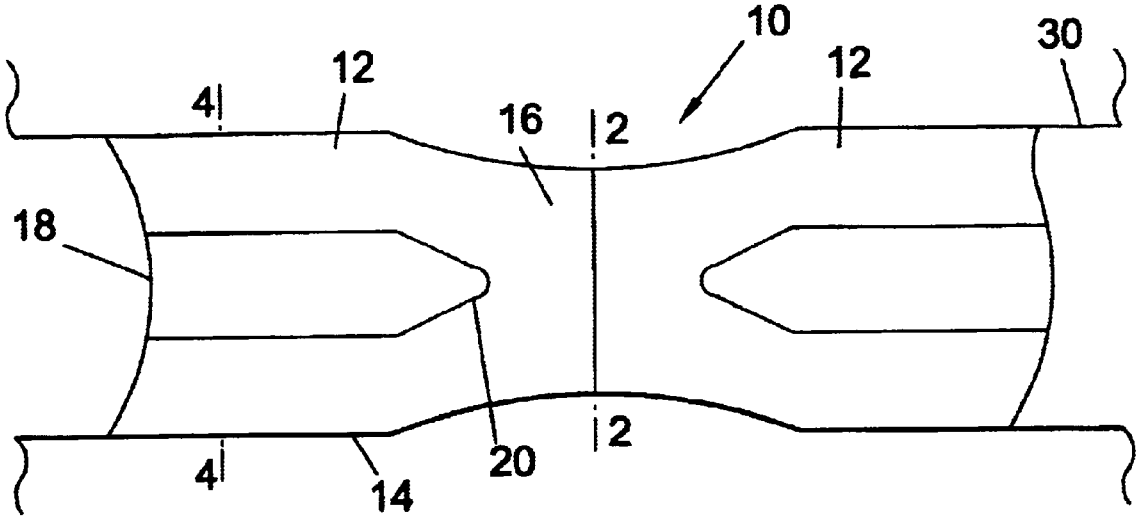
FIG. 1 is a schematic view of a section of deformable downhole tubing in accordance with an embodiment of the present invention.
Figure 2:
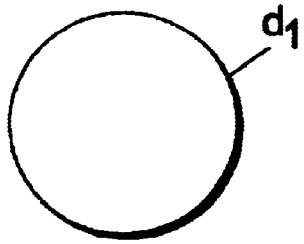
FIG. 2 is a sectional view on line 2—2 of FIG. 1.
Figure 3:
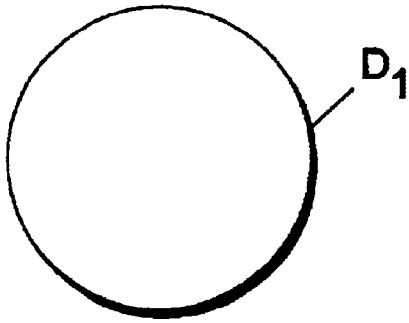
FIG. 3 is a sectional view corresponding to FIG. 2, showing the tubing following expansion.
Figure 4:
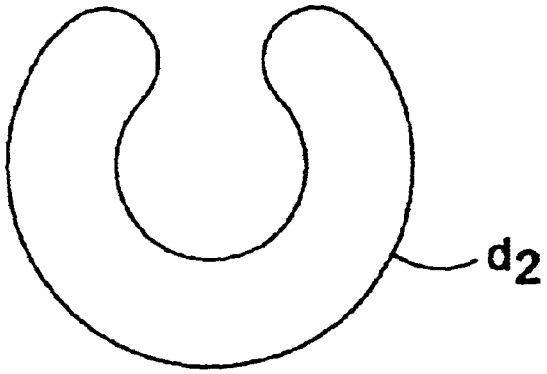
FIG. 4 is a sectional view on line 4—4 of FIG. 1.

Reference is first made to FIG. 1 of the drawings, which illustrates downhole tubing 10 in accordance with a preferred embodiment of the present invention. The tubing 10 is made up of a plurality of tubing sections 12, the ends of two sections 12 being illustrated in FIG. 1. Each tubing section 12 defines a continuous wall 14 such that the wall 14 is fluid tight. Each tubing section 12 comprises two substantially cylindrical end portions 16 which are initially of a first diameter $d_1$ (FIG. 2) and, as will be described, are expandable to a larger second diameter $D_1$ (FIG. 3). However, the majority of the length of each tubing section 12 is initially in a folded configuration, as illustrated in FIG. 4, describing a folded diameter $d_2$ and, as will be described, is unfoldable to a substantially cylindrical form of diameter $D_2$, and subsequently expandable to the same or similar diameter $D_1$ as the expanded end portions 16.

Between the end portions 16 and intermediate portions 18 of each tubing section 12 are transition portions 20 which are adapted to be deformed by a combination of unfolding and expansion to the diameter $D_1$.

In use, the tubing sections 12 may be coupled together on surface in a substantially similar manner to conventional drill pipe. To this end, the tubing section end portions 16 are provided with appropriate pin and box couplings. The thus formed tubing string may be run into a drilled bore 30 to an appropriate depth, and the tubing string then unfolded and expanded to create a substantially constant bore larger diameter tubing string of diameter $D_1$. The unfolding and the expansion of the tubing string may be achieved by any appropriate method, though it is preferred that the expansion is achieved by means of a rolling expander, such as described in WO00/37771, and U.S. Ser. No. 09/469,643, the disclosures which are incorporated herein by reference. The running and expansion process will now be described in greater detail with reference to FIG. 5 of the accompanying drawings.

Figure 5:
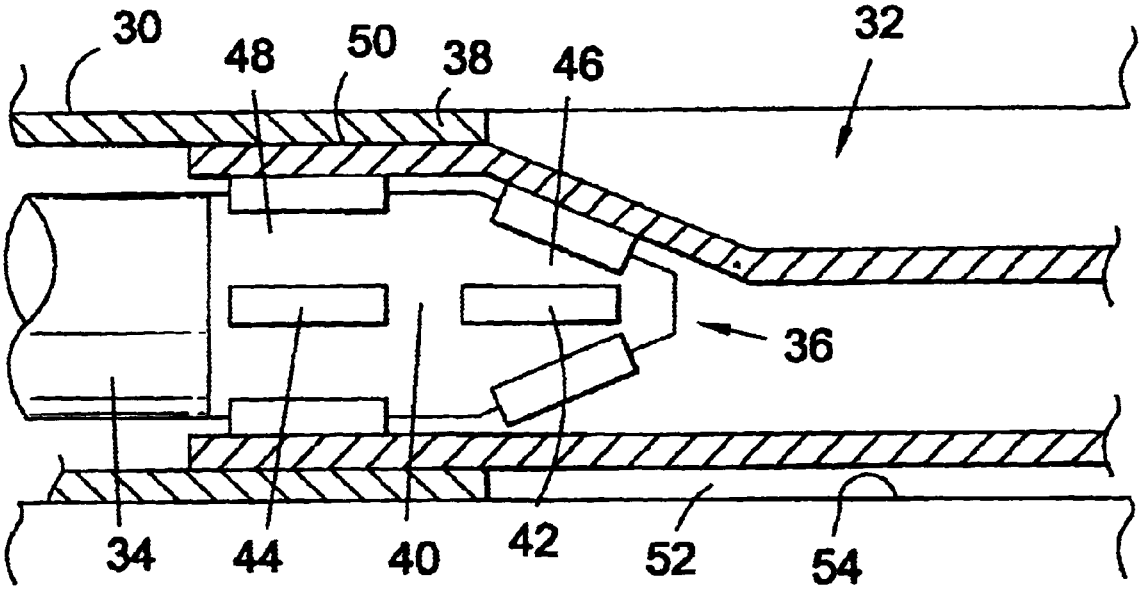
FIG. 5 is a schematic view of a step in the installation of a tubing string in accordance with an embodiment of the present invention.

FIG. 5 of the drawings illustrates the upper end of a tubing string 32 which has been formed from a plurality of tubing sections 12 as described above. The string 32 has been run into a cased bore 30 on the end of a running string 34, the tubing string 32 being coupled to the lower end of the running string 34 via a swivel (not shown) and a roller expander 36. In this particular example the tubing string 32 is intended to be utilised as bore-lining casing and is therefore run into a position in which the upper end of the string 32 overlaps with the lower end of the existing bore-lining casing 38.

The expander 36 features a body 40 providing mounting for, in this example, two sets of rollers 42, 44. The lower or leading set of rollers 42 are mounted on a conical body end portion 46, while the upper or following set of rollers 44 are mounted on a generally cylindrical body portion 48. The rollers 44 are mounted on respective pistons such that an increase in the fluid pressure within the running string 34 and the expander body 40 causes the rollers 44 to be urged radially outwardly.

On reaching the desired location, the fluid pressure within the running string 34 is increased, to urge the rollers 44 radially outwardly. This deforms the tubing section end portion 16 within which the roller expander 36 is located, to create points of contact between the tubing section end portion outer surface 50 and the inner face of the casing 38 at each roller location, creating an initial hanger for the tubing string 32. The running string 34 and roller expander 36 are then rotated. As the tubing string 32 is now held relative to the casing 38, the swivel connection between the roller expander 36 and the tubing 32 allows the expander 36 to rotate within the upper end portion 16. Such rotation of the roller expander 36, with the rollers 44 extended, results in localised reductions in thickness of the wall of the tubing section upper end portion 16 at the roller locations, and a subsequent increase in diameter, such that the upper end portion 16 is expanded into contact with the surrounding casing 38 to form a tubing hanger.

With the fluid pressure within the running string 34 and roller expander 36 being maintained, and with the expander 36 being rotated, weight is applied to the running string 34, to disconnect the expander 36 from the tubing 32 by activating a shear connection or other releasable coupling. The expander 36 then advances through the tubing string 32. The leading set of rollers 42 will tend to unfold the folded wall of the transition portion 20 and then the intermediate portion 18, and the resulting cylindrical tubing section is then expanded by the following set of rollers 44. Of course, as the expander 36 advances through the string 32, the expansion mechanisms will vary as the expander 36 passes through cylindrical end portions 16, transitions portions 20, and folded intermediate portions 18.

Once the roller expander 36 has passed through the length of the string 32, and the fluid pressure within the running string 34 and expander 36 has been reduced to allow the rollers 44 to retract, the running string 34 and expander 36 may be retrieved through the unfolded and expanded string 32. Alternatively, before retrieving the running string 34 and expander 36, the expanded string 32 may be cemented in place, by passing cement slurry down through the running string 34 and into the annulus 52 remaining between the expanded string 32 and the bore wall 54.

It will be apparent to those of skill in the art that the above-described embodiment is merely exemplary of the present invention, and that various modifications and improvements may be made thereto without departing from the scope of the invention. For example, the tubing described in the above embodiment is formed of solid-walled tube. In other embodiments the tube could be slotted or otherwise apertured, or could form part of a sandscreen. Alternatively, only a relatively short length of tubing could be provided, for use as a straddle or the like. Also, the above described embodiment is a "C-shaped" folded form, and those of skill in the art will recognise that the present application has application in a range of other configuration of folded or otherwise deformed or deformable tubing. Further, the present invention may be useful in creating a lined monobore well, that is a well in which the bore-lining casing is of substantially constant cross-section. In such an application, the expansion of the overlapping sections of casing or liner will be such that the lower end of the existing casing is further expanded by the expansion of the upper end of the new casing.

We claim:

1. Downhole apparatus comprising a plurality of tubing sections, each tubing section having: substantially cylindrical end portions initially of a first diameter adapted for coupling to end portions of adjacent tubing sections and said end portions being expandable at least to a larger second diameter; and intermediate folded wall portions initially in a folded configuration and being unfoldable to define a substantially cylindrical form of a third diameter.

2. The apparatus of claim 1, wherein transition portions are provided between the end portions and the intermediate portions of each tubing section, and said transition portions are deformable by a combination of both unfolding and expansion.

3. The apparatus of claim 1, wherein the end portions are threaded.

4. The apparatus of claim 1, wherein the first diameter is smaller than the third diameter.

5. The apparatus of claim 1, wherein the second and third diameters are substantially the same.

6. The apparatus of claim 1, wherein the unfolded intermediate wall portion is expandable from the third diameter to a larger fourth diameter.

7. The apparatus of claim 6, wherein the fourth diameter is substantially the same as the second diameter.

8. A method of lining a bore comprising the steps:

providing a plurality of tubing sections, each tubing section having substantially cylindrical end portions of a first diameter and an intermediate folded wall portion in a folded configuration;

coupling the tubing sections together via the end portions to form a tubing string;

running the tubing string into a bore; and reconfiguring the tubing string by expanding the end portions at least to a larger second diameter and unfolding the intermediate folded wall portions to define a substantially cylindrical form of a third diameter.

9. The method of claim 8, further comprising reconfiguring transition portions between the end portions and the intermediate portions by a combination of both unfolding and expansion.

10. The method of claim 8, comprising threading the tubing sections together.

11. The method of claim 8, wherein the first diameter is smaller than the third diameter.

12. The method of claim 8, wherein the second and third diameters are substantially the same.

13. The method of claim 8, further comprising the step of expanding the unfolded intermediate wall portions from the third diameter to a larger fourth diameter.

14. The method of claim 13, wherein the fourth diameter is substantially the same as the second diameter.

15. The method of claim 8, wherein at least one of the unfolding and expansion steps is achieved by rolling expansion utilising a rotating body carrying one or more rolling members.

16. The method of claim 15, wherein both the unfolding and expansion steps are achieved by rolling expansion.

17. The method of claim 15, wherein the unfolding step is achieved by rotation and axial advancement of a set of rolling members arranged in a conical form.

18. The method of claim 15, wherein the expansion step is achieved by a set of rolling members arranged to be urged radially outwardly into contact with the tubing section wall.

19. The method of claim 8, wherein the unfolding step is achieved by bending of the tubing wall.

20. The method of claim 8, wherein the expansion step is achieved by radial deformation of the wall, reducing the wall thickness and thus increasing the wall diameter.

21. A method of creating a bore liner, the method comprising:

providing a tubing section having a folded wall and describing a folded diameter;

running the tubing section into a bore;

unfolding the wall of the tubing section to define a larger unfolded diameter; and expanding the unfolded wall of the tubing section to a still larger diameter.

22. The method of claim 21, wherein at least one of the unfolding and expansion steps is achieved by rolling expansion utilising a rotating body carrying one or more rolling members.

23. The method of claim 22, wherein the unfolding step is achieved by rotating and advancing a set of rolling members arranged in a conical form.

24. The method of claim 22, wherein the expansion step is achieved by rotating and advancing a set of rolling members arranged to be urged radially outwardly into contact with the unfolded tubing section wall.

25. The method of claim 21, wherein the unfolding is achieved by simple bending of the tubing wall.

26. The method of claim 21, wherein the expansion is achieved by radial deformation of the wall, reducing the wall thickness and thus increasing the wall diameter.

27. The method of claim 21, wherein the tubing section is formed of a plurality of pipe sections which are connected at surface to make up a tubing string.

28. The method of claim 21, wherein an upper portion of the tubing section is deformed initially, into contact with a surrounding wall, to create a hanger and to fix the tubing section in the bore.

29. The method of claim 28, wherein said upper portion is initially substantially cylindrical and is expanded to create the hanger.

30. The method of claim 21, wherein the tubing section is expanded into contact with the bore wall over at least some of the length of the tubing section.

31. The method of claim 21, wherein an annulus remains between the tubing section and the bore wall, and the annulus is at least partially filled b a settable material.

* * * * *